US006808251B2

(12) United States Patent
Hiwatashi et al.

(10) Patent No.: US 6,808,251 B2
(45) Date of Patent: Oct. 26, 2004

(54) NOZZLE PLATE FOR INK-JET PRINTER AND METHOD FOR MANUFACTURING THE SAME

(75) Inventors: Tatsuya Hiwatashi, Fukuoka (JP); Tohru Nakagawa, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 17 days.

(21) Appl. No.: 10/322,030

(22) Filed: Dec. 17, 2002

(65) Prior Publication Data

US 2003/0132992 A1 Jul. 17, 2003

(30) Foreign Application Priority Data

Jan. 15, 2002 (JP) ..... 2002-006435

(51) Int. Cl.[7] ..... B41J 2/14; B41J 2/135

(52) U.S. Cl. ..... 347/47; 347/45

(58) Field of Search ..... 427/490; 29/890.1; 216/27; 347/20, 44, 45, 47, 63, 64

(56) References Cited

U.S. PATENT DOCUMENTS 5,502,470 A * 3/1996 Miyashita et al. ..... 347/45
5,759,421 A * 6/1998 Takemoto et al. ..... 216/27
5,949,454 A * 9/1999 Nozawa et al. ..... 347/45
6,109,728 A * 8/2000 Kakuda et al. ..... 347/45
6,126,269 A * 10/2000 Takemoto et al. ..... 347/45
6,186,616 B1 * 2/2001 Inoue et al. ..... 347/45

FOREIGN PATENT DOCUMENTS

JP 04299150 A 10/1992

* cited by examiner

*Primary Examiner*—K. Feggins
*Assistant Examiner*—An H. Do
(74) *Attorney, Agent, or Firm*—Harness, Dickey & Pierce, P.L.C.

(57) ABSTRACT

In manufacturing a nozzle plate for an ink-jet printer including a nozzle hole to jet ink formed so as to penetrate the nozzle plate in the thickness direction thereof and a water-repellent film formed on an ink downstream-side surface of the both sides of the nozzle plate at which the nozzle hole is opened, firstly the water-repellent film is formed by Sol-Gel process, and then the nozzle hole is formed. A thickness of the water-repellent film is formed less than 1 $\mu$m.

1 Claim, 7 Drawing Sheets

NOZZLE PLATE FOR INK-JET PRINTER AND METHOD FOR MANUFACTURING THE SAME

BACKGROUND OF THE INVENTION

The present invention relates to a nozzle plate for an ink-jet printer and a method for manufacturing the same. More specifically, the present invention relates to a technical field in which a nozzle hole to jet ink is formed so as to penetrate the nozzle plate in the thickness direction thereof and a water-repellent film is formed on an ink downstream-side surface of the both sides of the nozzle plate at which the nozzle hole is opened.

Conventionally, an ink-jet head that jets ink in a pressure chamber from a nozzle is well known, in which there is provided the pressure chamber with ink filled up therein, a nozzle connected to the pressure chamber, and a pressure impressing device, such as a piezoelectric actuator, impressing a pressure to the pressure chamber to jet ink from the nozzle. In general, the nozzle includes a nozzle hole that penetrates a nozzle plate in the thickness direction thereof, and a water-repellent film is formed on an ink downstream-side (ink jetting-side) surface of the both sides (both sides that are opposite to each other in the thickness direction of the nozzle plate) of the nozzle plate at which the nozzle hole is opened. Here, the water-repellent film is provided so that the ink downstream-side surface, especially a portion surrounding the nozzle hole, can be prevented from being wet by the ink, resulting in an excellent maintenance of ink jetting function from the nozzle. That is, if the portion surrounding the nozzle hole is wet by ink, a direction, a speed or amount of jetting ink may be changed according to a degree of how much the ink is wet. Therefore, in order to improve stability and accuracy of printing, it may be necessary that such water-repellent film is formed on the ink downstream-side surface of the nozzle plate.

Meanwhile, the nozzle hole is formed by pressing, as shown for example in Japanese Patent Laid-Open Publication No. 4-299150. In this case, if the water-repellent film is formed before forming the nozzle hole by the press processing, part of the water-repellent film surrounding the nozzle hole may be damaged and worn off by the press processing subsequently applied. That is, the conventional process provides a water-repellent film formed by plating with considerably increased thickness of the film. Therefore, part of water-repellent film surrounding the nozzle hole may be worn off easily by the press processing subsequently applied.

Even if the water-repellent film is formed by other methods than plating, as long as a thickness of the film formed is as considerably big as that by conventional plating, the water-repellent film may be worn off easily during forming the nozzle hole. Further, even other forming process than the press processing, such as electric discharge processing, laser processing or the like, are applied, the water-repellent film with a big thickness thereof may be damaged and worn off easily.

Accordingly, in the conventional process for forming water-repellent film and nozzle hole, forming water-repellent film is done after forming nozzle hole.

However, if forming water-repellent film is done after forming nozzle hole like the conventional process, it should be difficult for part of water-repellent film surrounding the nozzle hole just close to an edge of the hole to be formed uniformly around there. Even if the above process can provide better forming of the water-repellent film, compared to the process in which forming nozzle holes is done after forming water-repellent film, forming water-repellent film after forming nozzle hole with any hole-forming processing should cause a problem that some ink-wet area is formed around the edges of the nozzle holes inevitably. Accordingly, further improvement to reduce this ink-wet area as much as possible for increasing accuracy of printing will be demanded.

SUMMARY OF THE INVENTION

In view of the above-described conventional problem, it is an object of the present invention to provide a water-repellent film that is formed as uniformly as possible, extending just close to the edge of the nozzle hole so as to improve accuracy of printing.

In order to achieve the above object, the present invention provides a nozzle plate for an ink-jet printer comprising a nozzle hole to jet ink formed so as to penetrate the nozzle plate in the thickness direction thereof and a water-repellent film formed on an ink downstream-side surface of the both sides of the nozzle plate at which the nozzle hole is opened, wherein a thickness of the water-repellent film is less than 1 $\mu$m.

According to the nozzle plate for an ink-jet printer of the present invention, the nozzle hole can be formed after forming the water-repellent film. That is, the thickness of the water-repellent film is so thin that a portion surrounding the nozzle hole can be maintained at a state where a film over the portion is not easy to get damaged and substantially uniform even if the nozzle hole is formed after forming the water-repellent film. Meanwhile, the water-repellent film can be formed easily by Sol-Gel process and a fixing strength of the film on the nozzle plate can be high even if the film is so thin. Accordingly, it can improve a function of the ink jet resulting in increasing accuracy of printing.

Further, it is preferred that the present invention provides a nozzle plate for an ink-jet printer of the above, wherein the nozzle plate is formed so that an area of a portion surrounding the nozzle hole that is wet by ink and formed at the ink downstream-side surface is less than 10% of an opening area of the nozzle hole formed at the ink downstream-side surface when at least the nozzle hole of the nozzle plate is once dipped in ink of a container in such a manner that the ink downstream-side surface thereof is positioned so as to be substantially perpendicular to a surface of ink and then pulled up.

That is, when at least the nozzle hole of the nozzle plate is dipped in ink and then pulled up, the ink is repelled by the water-repellent film resulting in ink dripping away from the surface of the nozzle plate. Accordingly, in general, no portion that is wet by the ink on the surface of the downstream-side surface of the plate may exist. However, it should be difficult to form the water-repellent film uniformly to perfection just over the portion surrounding the nozzle hole. Therefore, the ink-wet portion may exist. However, if the area of the ink-wet portion is less than 10% of the opening area of the nozzle hole formed at the ink downstream-side surface, it can be said that the function of ink jetting is good and the part of water-repellent film surrounding the nozzle hole just close to an edge of the hole is substantially formed uniformly. In other words, if the area of the ink-wet portion is this much, a direction of ink jet can be stable, resulting in suppressing a deviation of ink drops from proper ink-adhered positions in a sub-scanning direction to a certain degree (less than 4 $\mu$m) in which little lateral lines or the like is printed. Further, a speed of ink jet can also be stabilized, so that the deviation of the ink drops from proper ink-adhered positions in a main-scanning direction can be suppressed.

Further, it is preferred that the present invention provides a method for manufacturing a nozzle plate for an ink-jet printer, in which firstly a water-repellent film is formed and then a nozzle hole is formed.

Specifically, that is a method for manufacturing a nozzle plate for an ink-jet printer, in which the nozzle plate includes a nozzle hole to jet ink formed so as to penetrate the nozzle plate in the thickness direction thereof and a water-repellent film formed on an ink downstream-side surface of the both sides of the nozzle plate at which the nozzle hole is opened, the method comprising the steps of forming the water-repellent film on one surface of the both sides of a plate material by Sol-Gel process and forming the nozzle hole so as to penetrate the plate material in the thickness direction thereof after forming the water-repellent film.

According to the method for manufacturing a nozzle plate for an ink-jet printer of the present invention, it can be easy to make the water-repellent film considerably thin and the water-repellent film with a high fixing strength on the nozzle plate can be provided even if the film is considerably thin. Therefore, even if the nozzle hole is formed after forming the water-repellent film, the portion of the water-repellent film surrounding the nozzle hole can be formed uniformly so that it should not be easy to get damaged. Accordingly, it can improve the function of the ink jet resulting in increasing accuracy of printing.

Further, it is preferred that a thickness of the water-repellent film formed in the above step of forming the water-repellent film is less than 1 $\mu$m.

According to this, it can improve the function of the ink jet certainly, as described above.

Further, it is preferred that the above step of forming the nozzle hole is a step of forming the nozzle hole by applying electric discharge processing or laser processing.

According to this, a portion of the water-repellent film surrounding the nozzle hole can be formed more uniformly, compared to the nozzle hole formed by pressing.

DETAILED DESCRIPTION OF THE INVENTION

Hereinafter, a preferred embodiment of the present invention will be described with reference to the accompanying drawings.

Figure 1:
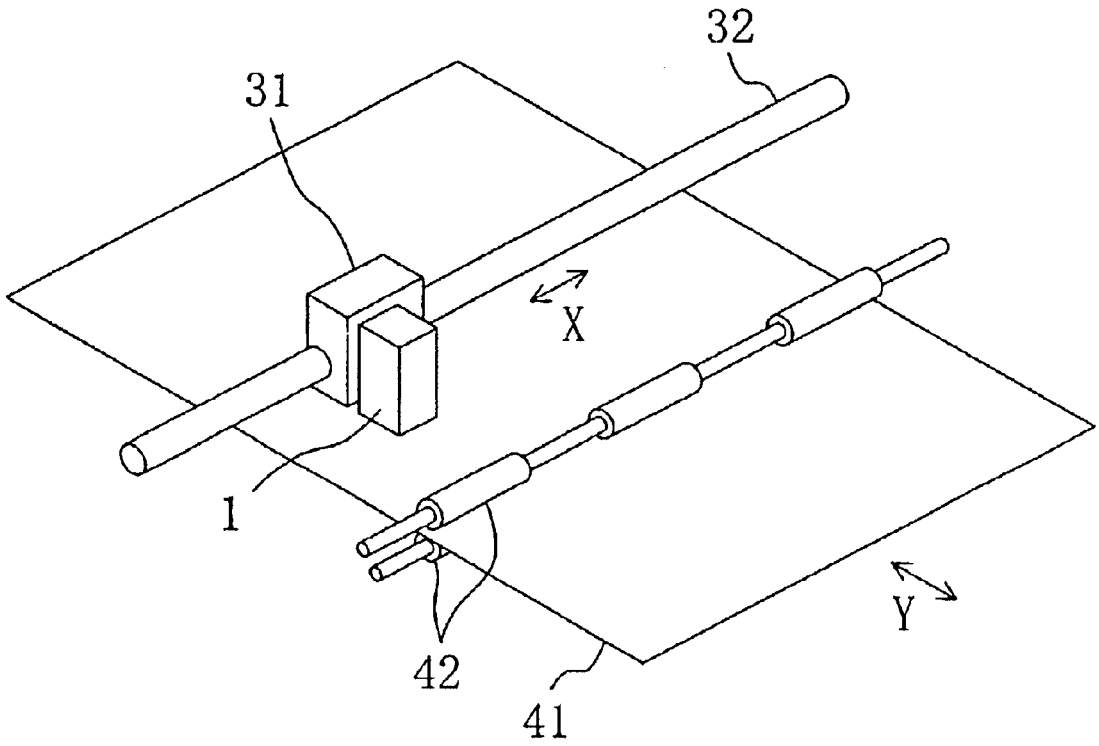
FIG. 1 is a schematic perspective view of an ink-jet printer with an ink-jet head equipped with a nozzle plate in an embodiment of the present invention.

FIG. 1 shows schematically an ink-jet printer with an ink-jet head 1 equipped with a nozzle plate 9 (referring to FIG. 2 through FIG. 4) in an embodiment of the present invention. The ink-jet head 1 is provided to jet ink to a recording paper 41, which is a recording medium, as described hereinafter. The ink-jet head 1 is supported on a carriage 31 that is equipped with a carriage motor (not shown). The ink-jet head 1 and the carriage 31 are guided by a carriage axis 32 that extends in a main-scanning direction (direction X shown in FIGS. 1 and 2) and driven by the carriage motor so as to go and return in that direction. The carriage 31, the carriage axis 32 and the carriage motor constitute a relatively moving device that moves relatively the ink-jet head 1 and the recording paper 41 in the main-scanning direction.

The recording paper 41 is supplied under the ink-jet head 1 in a sub-scanning direction (direction Y shown in FIGS. 1 and 2) that is perpendicular to the main-scanning direction by two supply rollers 42 and a supply motor (not shown), in which the supply rollers 42 are driven by the supply motor and put the recording paper 41 between them.

Figure 2:
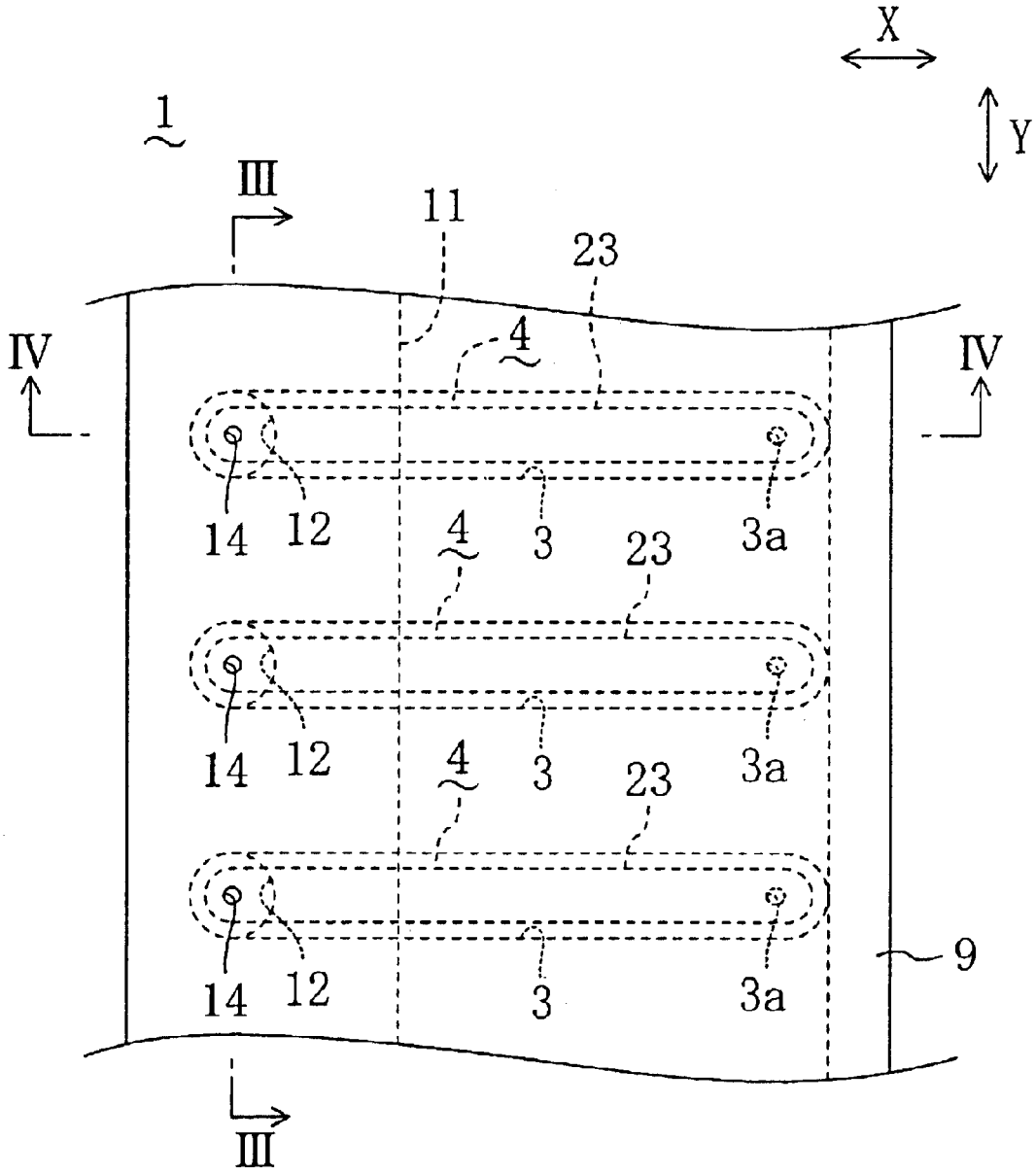
FIG. 2 is a partial bottom plan view of the ink-jet head.
Figure 3:
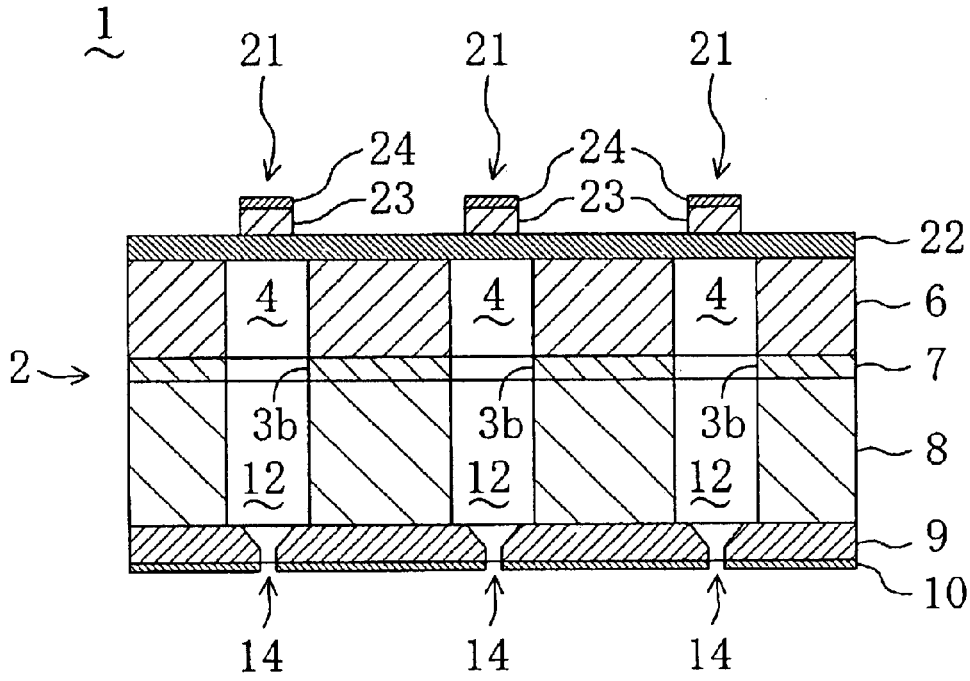
FIG. 3 is a sectional view taken on line III—III of FIG. 2.
Figure 4:
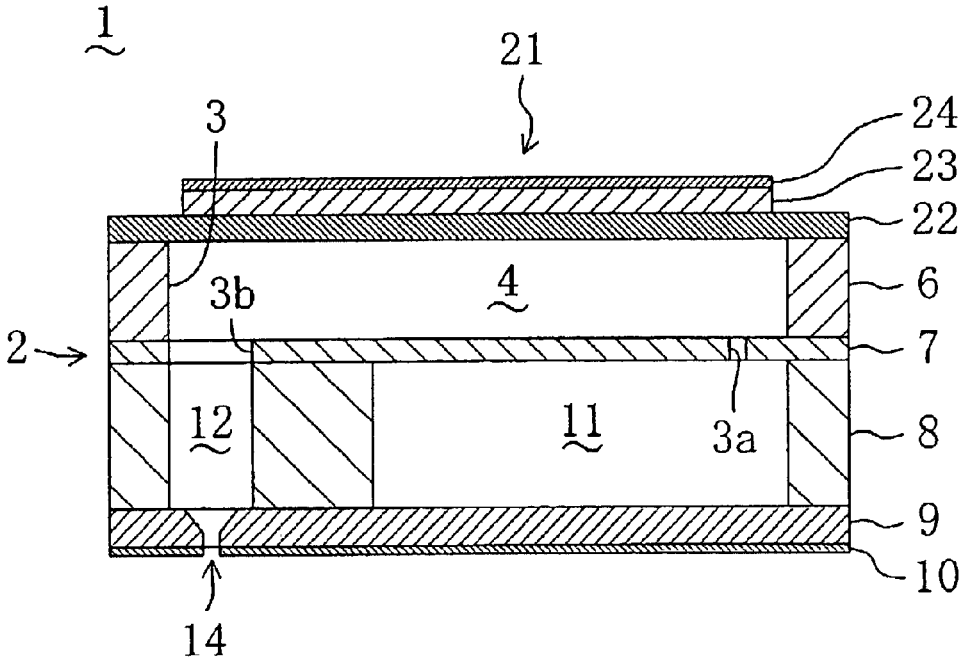
FIG. 4 is a sectional view taken on line IV—IV of FIG. 2.

The ink-jet head 1, as shown in FIG. 2 through FIG. 4, includes a head body 2 that is equipped with plural pressure chamber concaves 3 having a supply port 3*a* to supply ink and a discharge port 3*b* to discharge ink. The concaves 3 are formed so that upper ends thereof open at an upper surface of the head body 2 respectively and their opened portions extend in the main-scanning direction respectively, in which the respective concaves 3 are disposed away from each other in the sub-scanning direction with substantially equal distance between them. Both sides of the opened portion of each concave 3 are formed substantially in half-circle shape.

The side wall of each concave 3 of the head body 2 is made of a first plate member 6 of photosensitive glass having a thickness of approximately 200 $\mu$m, and the bottom wall of each concave 3 is made of a second plate member 7 fixed on the bottom surface of the first plate member 6. The second plate member 7 is made of a stainless steel plate having a thickness of approximately 30 $\mu$m and includes the above supply port 3*a* and discharge port 3*b*.

Further, a third plate member 8 that is made of plural stainless steel plates adhered to one another and has a total thickness of approximately 300 $\mu$m is fixed on the bottom surface of the second plate member 7. The third plate member 8 includes one ink supply passage 11 connected to each supply port 3*a* of each concave 3 and extending in the sub-scanning direction and plural ink discharge passages 12 connected to the discharge ports 3*b* of the concaves 3 respectively. The ink supply passage 11 is coupled to an ink tank (not shown) so that ink may be supplied to the ink supply passage 11 from the tank.

The nozzle plate 9 is fixed on the bottom surface of the third plate member 8 so that the nozzle plate 9 forms the bottom surface of the ink-jet head 1. The nozzle plate 9 is made from a stainless steel plate with a thickness of approximately 70 $\mu$m. The nozzle plate 9 includes plural nozzles 14 to jet ink drops to the recording paper 41 that are formed of nozzle holes penetrating the nozzle plate 9 in its thickness direction. The nozzle holes open on both surfaces of the nozzle plate 9 which are opposite to one another. Each nozzle 14 is connected to the ink discharge passage 12 and further connected to the discharge port 3*b* of the concave 3 through the passage 12. The ends of the nozzles 14 (ink downstream-side openings of the nozzle holes) are disposed so as to form in line on the bottom surface of the ink-jet head 1 in the sub-scanning direction.

The nozzle 14, a nozzle axis (center axis of the nozzle hole) of which extends in the thickness direction of the nozzle plate 9, includes a taper portion with its nozzle diameter (diameter of nozzle hole) decreasing toward the side of the nozzle end (ink downstream-side) and a straight portion disposed at the nozzle end with an uniform nozzle diameter of approximately 20 μm.

A water-repellent film 10 is formed on an ink downstream-side (ink discharge-side) surface (lower surface) of the both sides of the nozzle plate 9 in the thickness direction thereof (both sides at which the nozzle holes are opened). The water-repellent film 10 is formed by Sol-Gel process, which will be described hereinafter, and has a film thickness of less than 1 μm.

Figure 5:
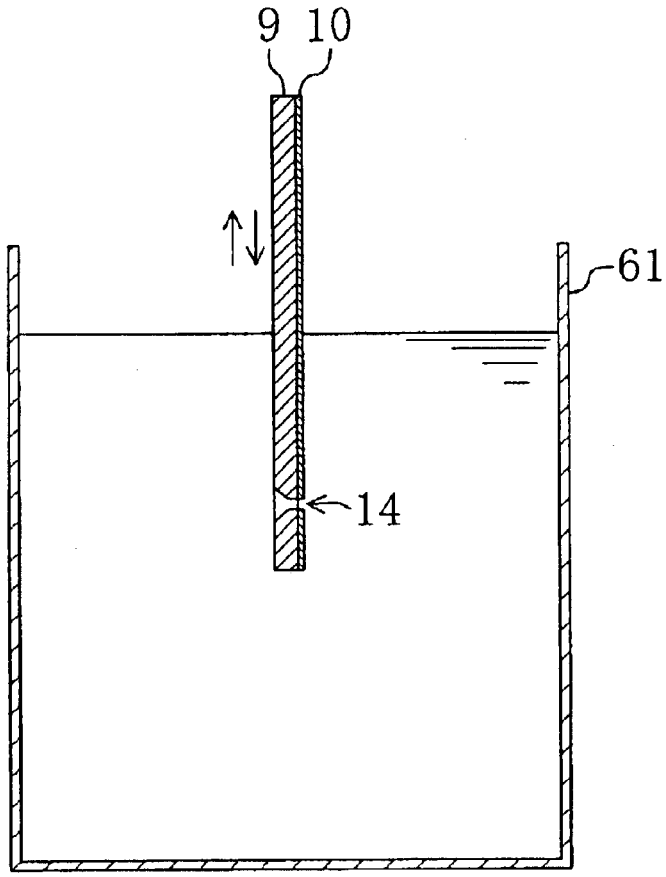
FIG. 5 is a sectional view showing a process in which the nozzle plate is dipped in ink in a container and then pulled up.
Figure 6:
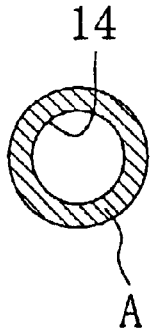
FIG. 6 is a view showing a portion surrounding a nozzle hole that is wet by ink, seeing from ink-downstream side.

The nozzle hole of the nozzle 14 is formed by electric discharge processing or laser processing after forming the water-repellent film 10. Accordingly, the nozzle plate 9 is formed so that an area of a portion surrounding the nozzle hole that is wet by ink (a portion illustrated with oblique lines in FIG. 6, which will be referred to as "ink-wet portion A" hereinafter) is less than 10% of an opening area of the nozzle hole formed at the ink downstream-side surface when the nozzle plate 9 is dipped in ink once and then pulled up. That is, as shown in FIG. 5, at least the nozzle hole of the nozzle plate 9 (or an entire part of the nozzle plate 9) is dipped in ink in a cylindrical container 61 with a bottom thereof once in such a manner that the ink downstream-side surface is positioned so as to be substantially perpendicular to a surface of ink and then it is pulled up. In this case, any duration when the plate has been dipped in or any speed for being pulled up may be adopted. Here, when the nozzle plate 9 is pulled up, ink is repelled by the water-repellent film 10 resulting in ink dripping away from the surface of the nozzle plate 9. Accordingly, in general, no portion that is wet by the ink on the surface of the downstream-side surface of the plate 9 may exist. However, it should be difficult to form the water-repellent film 10 uniformly just over the portion surrounding the nozzle hole. Therefore, the ink-wet portion A exists as shown in FIG. 6. In this embodiment, the nozzle plate 9 is made as described hereinafter, so that the area of the ink-wet portion A becomes less than 10% of the opening area of the nozzle hole formed at the ink downstream-side surface.

Piezoelectric actuators 21 are respectively disposed over the concaves 3 of the head body 2. The piezoelectric actuators 21 include a vibration plate 22 of Cr with a thickness of approximately 6 μm that is fixed on the upper surface of the head body 2 and covers all concaves 3 of the head body 2 so as to form pressure chambers 4 together with the concaves 3. The vibration plate 22 is a common one to all piezoelectric actuators 21 and works as a common electrode to all piezoelectric devices 23 which will be described hereinafter.

The piezoelectric actuator 21 includes a piezoelectric device 23 (piezoelectric constant is approximately $8\times10^{-11}$ m/V) of lead zirconate titanate (PZT) with a thickness of approximately 3 μm provided correspondingly to each pressure chamber 4 (correspondingly to each opening of the concave 3) on the surface (upper surface) of the vibration plate 22 opposite to the corresponding pressure chamber 4, and an individual electrode 24 of Pt with a thickness of approximately 0.2 μm provided on the surface (upper surface) of each piezoelectric device 23 opposite to the vibration plate 22 for applying a voltage (driving voltage) to the piezoelectric device 23 together with the vibration plate 22. The piezoelectric device 23 and the individual electrode 24 are disposed in piles substantially at the center of the opening of the concave 3 of the head body 2 in the width direction thereof, extending in the same direction as that of the opening of the concave 3 (in the main-scanning direction), and their both ends are formed substantially in a half-circle shape like the opening of the concave 3. The vibration plate 22, the piezoelectric device 23 and the individual electrode 24 are respectively formed in thin films by sputtering, which will be described hereinafter.

The piezoelectric actuator 21 functions in such a manner that the driving voltage applied to the piezoelectric device 23 through the vibration plate 22 and the individual electrode 24 deforms a portion (portion of the opening of the concave 3) corresponding to the pressure chamber 4 of the vibration plate 22, resulting in jetting the ink of the pressure chamber 4 from the nozzle 14 through the supply port **3*b* and the ink discharge passage 12. That is, when a pulse voltage is applied between the vibration plate 22 and the individual electrode 24, the piezoelectric device 23 shrinks in a width direction perpendicular to a thickness direction thereof at a rise of the pulse voltage by its piezoelectric effect, but the vibration plate 22 and the individual electrode 24 do not shrink. Therefore, this so-called bimetal effect makes the portion of the vibration plate 22 corresponding to the pressure chamber 4 to be deformed so as to protrude towards the pressure chamber 4. This deformation causes a pressure within the pressure chamber 4, and some ink in the pressure chamber 4 is discharged by this pressure thorough the discharge port 3*b* and the ink discharge passage 12 to be jetted onto the recording paper 41 from the nozzle 14 as ink drops, resulting in adhering onto the recording paper 41 in the shape of dots. Accordingly, the piezoelectric actuator 21 functions as a pressure impressing device that impresses the pressure to the pressure chamber 4 so as to jet the ink in the pressure chamber 4 from the nozzle 14. Then, at a fall of the pulse voltage, the piezoelectric device 23 elongates, so that the portion of the vibration plate 22 corresponding to the pressure chamber 4 returns to the original state. At this point, fresh ink is filled in the pressure chamber 4 from the ink tank through the ink supply passage 11 and the supply port 3*a*. In this case, a different type of pulse voltage applied to piezoelectric device 23** from the push-pull type described above can be adopted, such as a pull-push type in which the pulse voltage falls down from a first voltage to a second voltage that is lower than the first voltage and then it rises up to the first voltage again.

Applying the driving voltage to the piezoelectric device 23 is executed every certain period of time (for example, approximately 50 μs with driving frequency of 20 kHz) while moving the ink-jet head 1 and the carriage 31 in the main-scanning direction from one end to the other end of the recording paper 41 at a substantially constant speed (however, when the ink-jet head 1 reaches to a point on the recording paper 41 where the ink drop is not needed, the voltage is not applied), resulting in adhering the ink drop onto a certain position of the recording paper 41. After recording with one scanning is finished, the recording paper 41 is supplied with a certain displacement in the sub-scanning direction by the supply motor and the supply roller 42. Then, the next recording with another scanning is done by jetted ink while moving the ink-jet head 1 and the carriage 31 in the main-scanning direction. Repetition of these movements forms a needed image on the entire recording paper 41.

Now, procedures in a method for manufacturing the ink-jet head 1 will be described with reference to FIG. 7A through FIG. 7F. In FIG. 7A through FIG. 7F, the ink-jet head 1 is illustrated upside down, inversely to that illustrated in FIGS. 3 and 4.

Figure 7A:
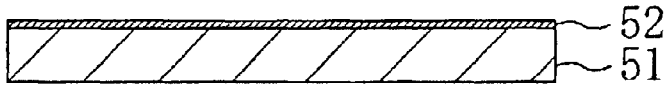
FIG. 7A through FIG. 7F are schematic diagrams showing a method for manufacturing the ink-jet head.
Figure 7B:
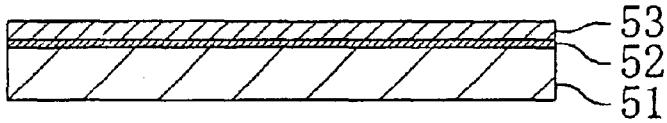
Figure 7C:
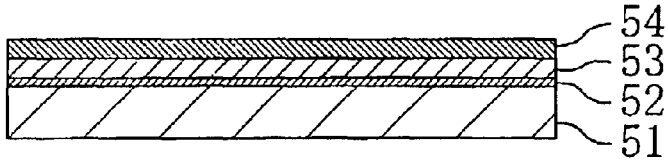

First, a Pt film 52 is formed on the entire surface of a supporting substitute 51 of MgO by sputtering (shown in FIG. 7A). Then, a PZT film 53 is formed on the entire Pt film 52 by sputtering (shown in FIG. 7B). Subsequently, a Cr film 54 is formed on the entire PZT film 53 (shown in FIG. 7C).

Figure 7D:
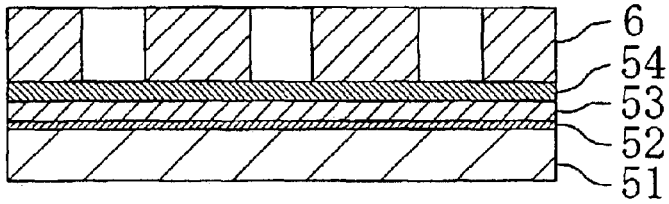
Figure 7E:
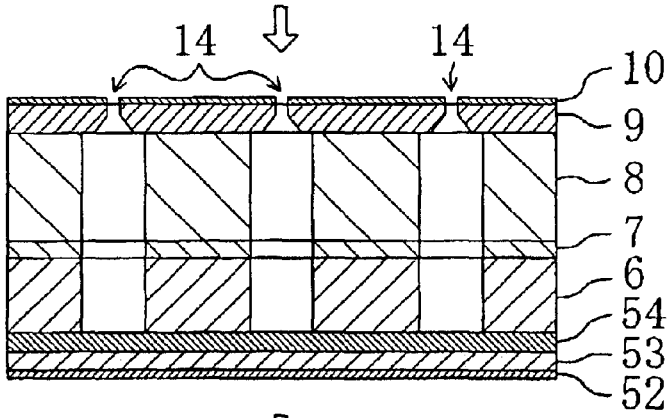

Next, the first plate member 6 of the head body 2 (some holes are formed in advance to make the concaves 3) is fixed on the upper surface of the Cr film 54 (shown in FIG. 7D). Then, the supporting substitute 51 is removed by melting with a heated phosphoric acid, KOH or the like, and the second plate member 7, the third plate member 8 and the nozzle plate 9, which are previously formed in certain shapes and then integrated, are fixed on the first plate member 6 (shown in FIG. 7E).

The water-repellent film 10 and the nozzle 14 (nozzle holes) are formed at the nozzle plate 9 before the nozzle plate 9 is fixed on the third plate member 8. A method for manufacturing the nozzle plate 9 will be described.

First, the water-repellent film 10 is formed by Sol-Gel process on one surface of a plate material made from stainless steel. For example, a coating liquid is made from a mixture of ethanol of 60 ml, 1,6-bis (trimethoxysilyl) hexane ($(CH_3O)_3Si(CH_2)_6Si(OCH_3)_3$) of 4 ml, (2-perfluorooctyl) ethyltrimethoxysilane ($CF_3(CF_2)_7C_2H_4Si(OCH_3)_3$) of 1 ml, water of 1 ml, and hydrochloric acid of 0.1 ml (36 volumetric %). Then, the coating liquid is coated on the plate material by spin coating. A thickness of the water-repellent film 10 is set to less than 1 $\mu$m by adjusting its coating speed and coating times during spin coating. Then, the coated liquid is dried at the temperature of a room for one hour and subsequently baked at 200° C. for thirty minutes, resulting in forming the water-repellent film 10 on the plate material.

Accordingly, the water-repellent film 10 is made in a film form by dehydration and polymerization of 1,6-bis (trimethoxysilyl) hexane ($(CH_3O)_3Si(CH_2)_6Si(OCH_3)_3$) and (2-perfluorooctyl) ethyltrimethoxysilane ($CF_3(CF_2)_7C_2H_4Si(OCH_3)_3$).

It is further preferable to use 1,4-bis (trimethoxysilylethyl) benzene ($(CH_3O)_3SiC_2H_4C_6H_4C_2H_4Si(OCH_3)_3$) in lieu to 1,6-bis (trimethoxysily ($(CH_3O)_3Si(CH_2)_6Si(OCH_3)_3$). Because, since 1,4-bis (thrimethoxysilylethyl) benzene ($(CH_3O)_3SiC_2H_4C_6H_4C_2H_4Si(OCH_3)_3$) has a benzene ring at the center thereof resistance and the packing density are increased compared with 1,6-bis (trimethoxysilyl) hexane ($(CH_3O)_3Si(CH_2)_6Si(OCH_3)_3$), with a result of increased wearability.

Next, nozzle holes are formed by applying electric discharge processing or laser processing to the plate material on which the water-repellent film 10 is formed, so that the nozzle plate 9 is completed.

The nozzle plate 9 manufactured by this method can make the area of the ink-wet portion A surrounding the nozzle hole formed at the ink downstream-side surface less than 10% of the opening area of the nozzle hole when at least the nozzle hole is dipped in ink once and then pulled up as described above.

Figure 7F:
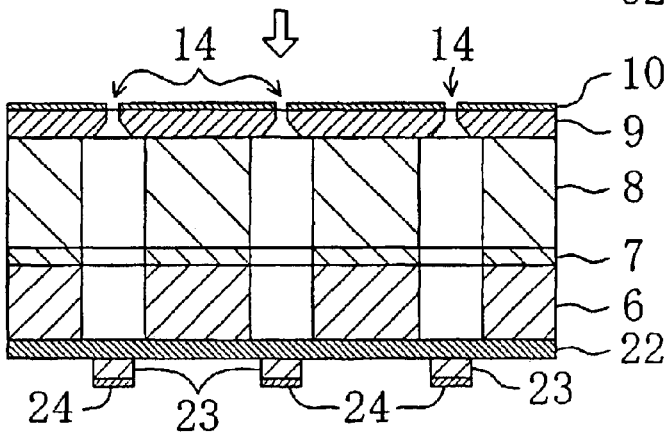

Subsequently, dividing the Pt film 52 and the PZT film 53 into some pieces corresponding to the pressure chambers 4 by dry etching forms respectively the individual electrodes 24 and piezoelectric devices 23 with certain shapes. Removal of unnecessary portion of the Cr film 54 by dry etching forms the vibration plate 22 as well (FIG. 7F).

Then, wiring of respective individual electrodes 24 and other necessary processes are done to finally complete the ink-jet head 1, which is not illustrated.

Accordingly, in this embodiment, the water-repellent film 10 is formed by Sol-Gel process, and after this the nozzle holes of the nozzle 14 are formed. Therefore, it can provide the water-repellent film 10 having considerably thin thickness and rigid fixation thereof, and the portion of the water-repellent film 10 surrounding the nozzle holes can be formed uniformly so that it should not be easy to get damaged even if the nozzle holes are formed after forming the water-repellent film 10. Further, the outer edge of the ink-wet portion A becomes approximately a circular shape. Especially, making the thickness of the water-repellent film 10 less than 1 $\mu$m can ensure making the area of the ink-wet portion A surrounding the nozzle hole less than 10% of the opening area of the nozzle hole formed at the ink downstream-side.

This constitution that the area of the ink-wet portion A surrounding the nozzle hole is less than 10% of the opening area of the nozzle hole formed at the ink downstream-side can make the direction of ink jet very stable, resulting in suppressing the deviation of the ink drops from proper ink-adhered positions in the sub-scanning direction to a certain degree (less than 4 $\mu$m) in which little lateral lines or the like is printed. Further, the speed of ink jet can also be stabilized, so that the deviation of the ink drops from proper ink-adhered positions in the main-scanning direction may be suppressed regardless of even some irregularity of moving speeds of the ink-jet head 1 and the carriage 31 in the main-scanning direction. Therefore, it can improve a function of ink jet and an accuracy of printing.

In this embodiment, each nozzle 14 is formed of the taper portion and the straight portion thereof However, it may be formed of only straight portion or in any other shapes.

Further, each nozzle 14 is not necessarily formed by electric discharge processing or laser processing, but may be formed by pressing or any other processing as long as a thickness of the water-repellent film 10 is made as thinner as possible by Sol-Gel process. However, electric discharge processing or laser processing can provide the water-repellent film 10 with more uniform portions surrounding the nozzle holes than pressing or the like.

Further, adoption of the method in which the water-repellent film 10 is formed by Sol-Gel process and after this the nozzle holes are formed can improve a function of ink jet even if the thickness of the water-repellent film 10 is in excess of 1 $\mu$m to some degree.

Further, materials of the water-repellent film 10 are not limited to those described in the above embodiment, and any other materials may be adopted as long as they are formed by Sol-Gel process.

Additionally, in the embodiment the vibration plate 22 of the piezoelectric actuator 21, the piezoelectric device 23 and the individual electrode 24 are formed in thin films by sputtering, but those may be formed in thin films by any other processes, such as CVD process, Sol-Gel process. Further, those vibration plate 22 and individual electrode 24 may be preformed in certain shapes instead of thin films and then those may be fixed together. However, forming in thin films shown in the embodiment may be more preferable. Because many piezoelectric actuators 21 can be made more easily and accurately by sputtering or etching, resulting in further improvement of productivity of the ink-jet head 1.

Further, in the embodiment the vibration plate 22 is formed as a common one for all piezoelectric actuators 21, but each vibration plate 22 may be provided for each piezoelectric actuator 21 like the piezoelectric device 23 and the individual electrode 24. Additionally, a separate electrode may be adopted so as to be disposed between the piezoelectric device 23 and the vibration plate 22, instead of the vibration plate 22 described above which functions as an electrode as well.

Further, in the embodiment the piezoelectric actuator 21 is adopted as the pressure impressing device that impresses the pressure to the pressure chamber 4 to jet the ink therein from the nozzle 14, but any other devices may be adopted.

Additionally, any alternatives may be adopted and, for example, the vibration plate 22, the piezoelectric device 23 and the individual electrode 24 of the piezoelectric actuator 21 may be formed of different materials and with different thickness from those in the above embodiment. Further, the first plate member 6 thorough the third plate member 8 and the nozzle plate 9 of the head body 2 may be formed of different materials and with different materials and with different thickness from those in the above embodiment. Further, any ways of disposition of the nozzle 14 (pressure chamber 4) may be adopted, and any shapes of the pressure chamber 4, the piezoelectric device 23 or the like may be adopted.

Next, actual examples will be described.

First, seven examples (Examples 1–7) of the nozzle plate with the same constitution as that described in the above embodiment have been manufactured. All of Examples 1–7 have been formed by Sol-Gel process and their nozzle holes have been formed after forming the water-repellent films, but they have different thickness of their water-repellent films and different processing of nozzle holes respectively (shown in Chart 1). Further, materials of their water-repellent films and details of their forming process are the same as those described above in the embodiment. Each thickness of the water-repellent film has been adjusted by spin speed and spin time thereof during its spin coatings as shown in Chart 2.

CHART 1

| | Process of forming water-repelling film | Thickness of water-repellent film [μm] | Processing of nozzle hole |
|---|---|---|---|
| Example 1 | Sol-Gel | 0.2 | Electric discharge processing |
| Example 2 | Sol-Gel | 0.5 | Electric discharge processing |
| Example 3 | Sol-Gel | 1.0 | Electric discharge processing |
| Example 4 | Sol-Gel | 1.5 | Electric discharge processing |
| Example 5 | Sol-Gel | 0.2 | Laser processing |
| Example 6 | Sol-Gel | 1.0 | Laser processing |
| Example 7 | Sol-Gel | 1.5 | Laser processing |
| Sample | Plating | 3.0 | Punching |

CHART 2

| Thickness of water-repellent film [μm] | Coating Speed [rpm] | Coating Times |
|---|---|---|
| 0.2 | 3000 | 1 |
| 0.5 | 1500 | 1 |
| 1.0 | 1000 | 2 |
| 1.5 | 800 | 2 |

Further, in order to make a comparison, a sample has been provided, in which the water-repellent film is formed by plating after forming the nozzle hole by pressing (punching).

Then, each area (a rate to the opening area of each nozzle hole formed at the ink downstream-side surface) of the ink-wet portion surrounding the nozzle hole formed at the ink downstream-side surface has been measured when each nozzle plate of Examples 1–7 and Sample had been dipped in ink and then pulled up.

Then, by using each nozzle plate of the Examples 1–7 and Sample, the same ink-jet heads as that described in the embodiment have been made and each of ink-jet speed and deviation of jetted ink drops in the sub-scanning direction (amount of a deviation from the proper ink-adhered position which is 1 mm away from the nozzle end in the sub-scanning direction) has been measured by a measuring device on the market while jetting ink from the nozzle hole of each ink-jet head.

Figure 8A:
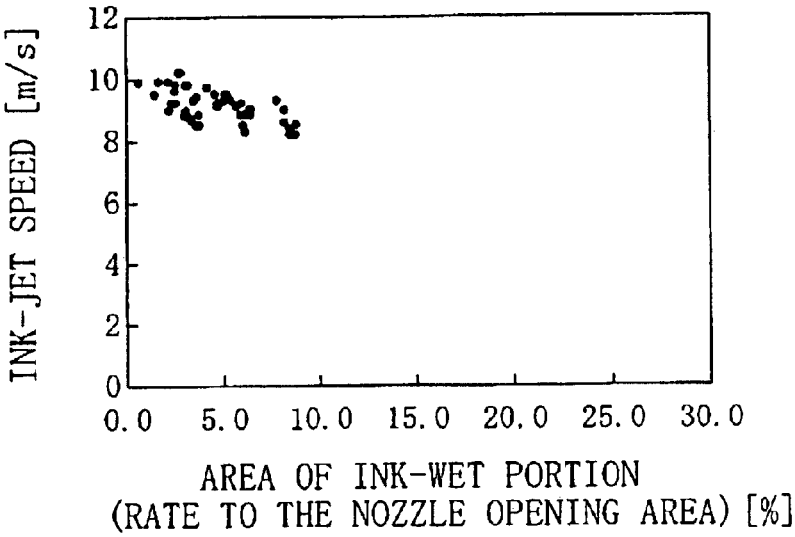
FIG. 8A is a graph showing a relationship between an area of ink-wet portion and an ink-jet speed in Example 3.
Figure 8B:
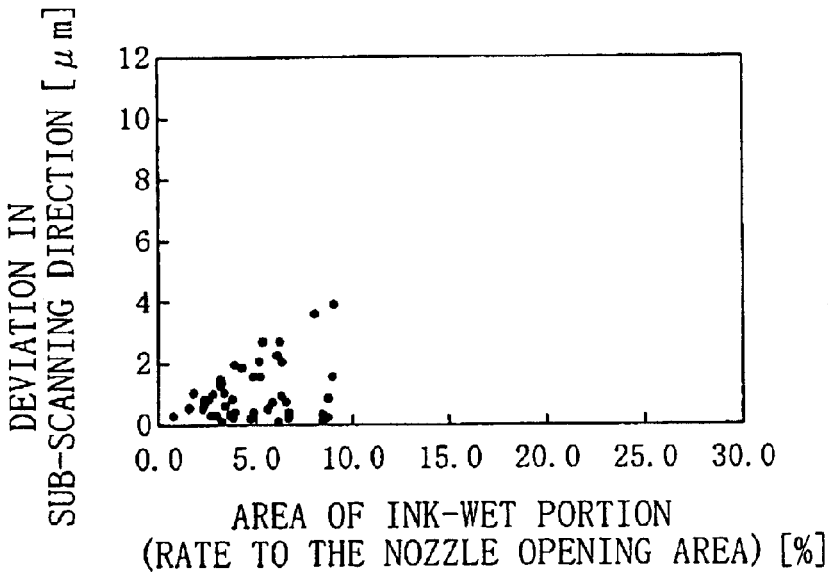
FIG. 8B is a graph showing a relationship between an area of ink-wet portion and a deviation in a sub-scanning direction in Example 3.
Figure 9A:
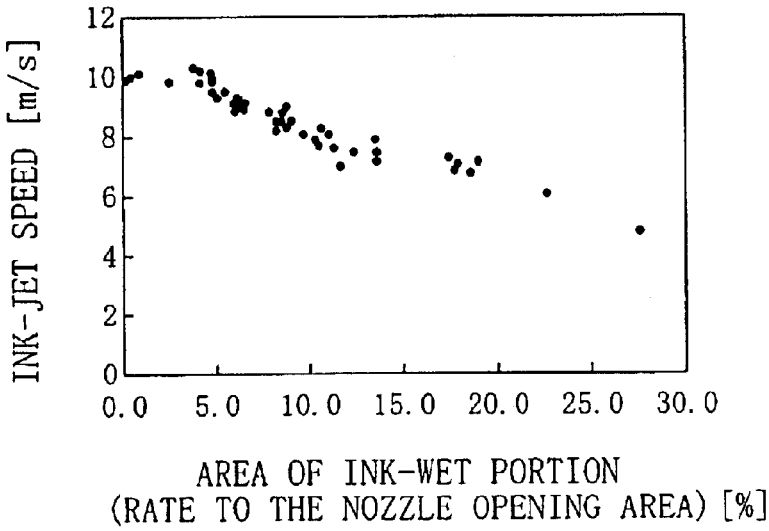
FIG. 9A is a graph showing a relationship between an area of ink-wet portion and an ink-jet speed in Sample.
Figure 9B:
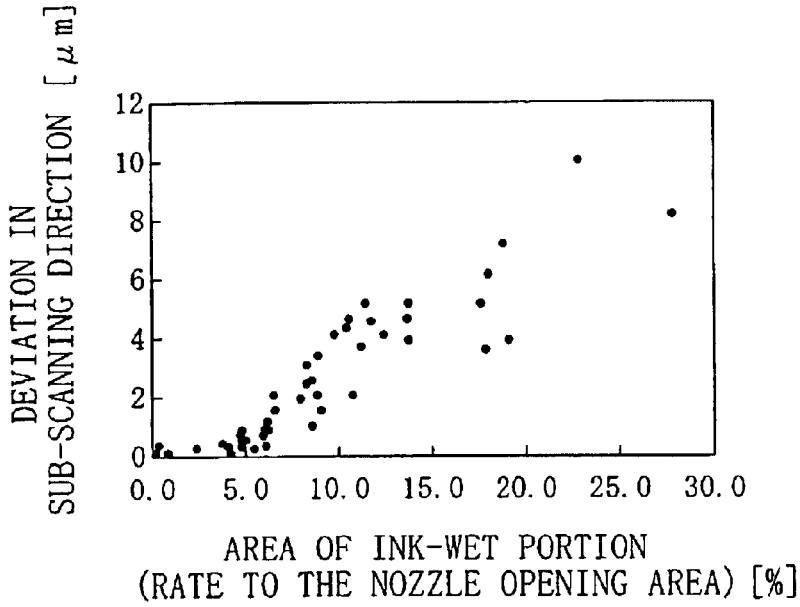
FIG. 9B is a graph showing a relationship between an area of ink-wet portion and a deviation in a sub-scanning direction in Sample.

Respective measuring results of the area of ink-wet portion (the rate to the nozzle opening area), the ink-jet speed and the deviation in the sub-scanning direction, which are described above, are shown in the Chart 3. Relationships between the area of ink-wet portion and the ink-jet speed and between the area of ink-wet portion and the deviation in the sub-scanning direction in Example 3 are shown in FIG. 8A and FIG. 8B respectively, and relationships between the area of ink-wet portion and the ink-jet speed and between the area of ink-wet portion and the deviation in the sub-scanning direction in Sample are shown in FIG. 9A and FIG. 9B respectively.

CHART 3

| | Area of ink-wet portion (Rate to the nozzle opening area) [%] | Ink-jet Speed [m/s] | Deviation in sub-scanning direction [μm] |
|---|---|---|---|
| Example 1 | up to 5 | 9.2–10.1 | up to 2.5 |
| Example 2 | up to 2 | 8.5–10.2 | up to 3.4 |
| Example 3 | up to 10 | 8.1–10.3 | up to 3.9 |
| Example 4 | up to 17 | 7.2–10.0 | up to 5.3 |
| Example 5 | up to 5 | 9.3–10.3 | up to 2.6 |

CHART 3-continued

| | Area of ink-wet portion (Rate to the nozzle opening area) [%] | Ink-jet Speed [m/s] | Deviation in sub-scanning direction [μm] |
|---|---|---|---|
| Example 6 | up to 10 | 8.0–10.2 | up to 3.8 |
| Example 7 | up to 16 | 7.5–10.0 | up to 5.5 |
| Sample | up to 28 | 4.8–10.2 | up to 9.8 |

According to the results, it is understood that the water-repellent film with its thickness of less than 1.0 μm can ensure that the area of the ink-jet portion is less than 10% of the nozzle opening area even if the nozzle hole is formed after forming the water-repellent film. Further, it is understood that if the area of the ink-jet portion is less than 10% of the nozzle opening area, the ink-jet speed of any ink drops is more than 8.0 m/s that is faster and accordingly more stable than the Sample, and the deviation in the sub-scanning direction is less than 4 μm that is less and accordingly more stable than the Sample.

Additionally, in Example 4 and Example 7 in which the water-repellent films have their thickness of 1.5 μm, there are some in which the area of the ink-wet portion to the nozzle opening area is over 10%. However, a rate of over 10% and the area of the ink-wet portion itself of these are rather small compared to the Sample, and further the outer edge of the ink-wet portion becomes approximately a circular shape. As a result, as shown in Chart 3, compared to the Sample, the ink-jet speed can becomes faster and accordingly more stable and the deviation in the sub-scanning direction can becomes less and accordingly more stable.

What is claimed is:

1. A nozzle plate for an ink-jet printer, comprising:

a nozzle hole to jet ink formed so as to penetrate the nozzle plate in the thickness direction thereof; and a water-repellent film formed on an ink downstream-side surface of the both sides of the nozzle plate at which said nozzle hole is opened, wherein a thickness of said water-repellent film is less than 1 $\mu$m, wherein said nozzle plate is formed so that an area of a portion surrounding said nozzle hole that is wet by ink and formed at the ink downstream-side surface is less than 10% of an opening area of said nozzle hole formed at the ink downstream-side surface when at least said nozzle hole of said nozzle plate is once dipped in ink of a container in such a manner that the ink downstream-side surface thereof is positioned so as to be substantially perpendicular to a surface of ink and then pulled up.

* * * * *